US008052464B2

(12) United States Patent
Maruishi et al.

(10) Patent No.: US 8,052,464 B2
(45) Date of Patent: Nov. 8, 2011

(54) CONNECTOR

(75) Inventors: Masatoshi Maruishi, Sakura (JP); Takashi Matsukawa, Sakura (JP)

(73) Assignee: Fujikura Ltd., Tokyo (JP)

( * ) Notice: Subject to any disclaimer, the term of this patent is extended or adjusted under 35 U.S.C. 154(b) by 8 days.

(21) Appl. No.: 12/676,497

(22) PCT Filed: Sep. 4, 2008

(86) PCT No.: PCT/JP2008/066008

§ 371 (c)(1), (2), (4) Date: Mar. 4, 2010

(87) PCT Pub. No.: WO2009/031631

PCT Pub. Date: Mar. 12, 2009

(65) Prior Publication Data

US 2010/0210120 A1 Aug. 19, 2010

(30) Foreign Application Priority Data

Sep. 6, 2007 (JP) ..... 2007-231839

(51) Int. Cl.
*H01R 9/07* (2006.01)

(52) U.S. Cl. ..... 439/496; 439/77

(58) Field of Classification Search ..... 439/77, 439/495, 496, 67

See application file for complete search history.

(56) References Cited

U.S. PATENT DOCUMENTS 3,084,302 A * 4/1963 Braeutigam ..... 439/327
5,083,939 A * 1/1992 Ittah ..... 439/496
5,967,831 A * 10/1999 Yamada et al. ..... 439/496
6,017,222 A * 1/2000 Kao ..... 439/67
6,692,294 B2 * 2/2004 Kobayashi ..... 439/496

FOREIGN PATENT DOCUMENTS

| | | | |
|---|---|---|---|
| JP | 60-109280 | U | 7/1985 |
| JP | 10-116660 | A | 5/1998 |
| JP | 2002-8789 | A | 1/2002 |
| JP | 2004-349127 | A | 12/2004 |
| JP | 2005-302417 | A | 10/2005 |
| JP | 2005-339984 | A | 12/2005 |
| JP | 3926540 | B2 | 6/2007 |

OTHER PUBLICATIONS

International Search Report of PCT/JP2008/066008, mailing date of Sep. 30, 2008.

* cited by examiner

*Primary Examiner* — Hien Vu
(74) *Attorney, Agent, or Firm* — Westerman, Hattori, Daniels & Adrian, LLP

(57) ABSTRACT

A connector is provided which includes a plug having a plurality of cables disposed on one side of the plug, and a socket mounted on a base substrate that is used to connect the plug. The plug includes a plate-like member and a flexible substrate fixed to the surroundings of the plate-like member. The plate-like member includes a planar portion approximately parallel to a substrate face of the base substrate, and a bent portion provided on the other side of the plug and extending in a direction approximately perpendicular to the base substrate. The socket includes a mating space which receives the bent portion from a direction approximately perpendicular to the base substrate when the plug and socket are connector-connected.

7 Claims, 6 Drawing Sheets

CONNECTOR

TECHNICAL FIELD

The present invention relates to a connector (connector structure) including a plug and a socket used for an electrical connection.

BACKGROUND ART

As an example of such a connector, in Patent Document 1 and Patent Document 2, there is disclosed a connector provided with a male plug to which a plurality of cables are connected, and a female socket to which the male plug is connected so as to be able to be inserted into and extracted from the socket.

In Patent Document 3, there is disclosed a connector provided with a plug composed of a female contact to which a plurality of cables are connected, and a receptacle mounted in a substrate and composed of a male contact.

[Patent Document 1] Japanese Patent No. 3926540

[Patent Document 2] Japanese Unexamined Patent Application, First Publication No. 2004-349127

[Patent Document 3] Japanese Unexamined Patent Application, First Publication No. 2005-339984

DISCLOSURE OF THE INVENTION

Problem to be Solved by the Invention

In the prior structures disclosed in Patent Documents 1 and 2, a direction in which the female socket mounted on a substrate receives the male plug is a direction parallel to the substrate. That is, the structures are using a so-called horizontal mating method. Therefore, there were disadvantages in that the efficiency/effectiveness of the mating operation is not so good, and also, in that the substrate mounting region and space are easily restricted.

In the prior structure disclosed in Patent Document 3, a direction in which the female contact of the plug receives the male contact of the receptacle on a substrate is a direction perpendicular to the substrate. However, it is an irregular and complicated structure in which the plug is provided with the female contact, and a structure in which such a plug is connected to the male contact of the receptacle on the substrate. Accordingly, it is not preferable in terms of the economics of parts manufacturing and assembly, and from the viewpoint of the workability and the reliability of the connector connection operation. Therefore, there is room for improvement.

Means for Solving the Problem

In order to solve the foregoing problems, according to a first aspect of this invention, there is provided a connector including a plug having a plurality of cables disposed on one side of the plug, and a socket mounted on a base substrate that is used to connect the plug, wherein the plug includes a plate-like member and a flexible substrate fixed to the surroundings of the plate-like member, the plate-like member includes a planar portion approximately parallel to a substrate face of the base substrate, and a bent portion provided on the other side of the plug and extending in a direction approximately perpendicular to the base substrate; and the socket includes a mating space which receives the bent portion from a direction approximately perpendicular to the base substrate when the plug and socket are connector-connected.

A second aspect of this invention is, in the connector according to the first aspect, a portion of the flexible substrate, which is fixed to the bent portion of the plate-like member, includes contact pads which constitute conduction elements when the plug and socket are connector-connected; and the socket includes contacts having an elastically-deformable leading end positioned in the mating space, thereby constituting corresponding conduction elements.

A third aspect of this invention is, in the connector according to the second aspect, the contact pads are provided only in one side of the portion of the flexible substrate with the bent portion of the plate-like member as a boundary.

A fourth aspect of this invention is, in the connector according to the second aspect, the contact pads are provided on both sides of the portion of the flexible substrate with the bent portion of the plate-like member as a boundary.

A fifth aspect of this invention is, in the connector according to the second aspect, the contact pads are provided on both sides of the portion of the flexible substrate so as to span both sides of the bent portion of the plate-like member.

A sixth aspect of this invention is, in the connector according to the first aspect, the flexible substrate includes a plurality of cable connection portions which are joined to the cables, and each cable connection portion uniquely conductively-connects one cable to a corresponding contact pad.

A seventh aspect of this invention is, in the connector according to the sixth aspect, the cable connection portions are provided on the portion of the flexible substrate which is fixed to a face of the planar portion of the plate-like member near to the base substrate among both faces of the planar portion of the plate-like member when the plug and socket are connector-connected.

An eighth aspect of this invention is, in the connector according to the first aspect, the cable includes a central core wire, an outer conductor of the surroundings of the core wire, and a sheath covering the whole, the plate-like member includes a metal plate, and the outer conductor of the cable is soldered to the plate-like member.

A ninth aspect of this invention is, in the connector according to the eighth aspect, plating with high solder affinity is applied to a portion of the plate-like member to which the outer conductor of the cable is soldered, and plating with low solder affinity is applied to the other portion.

Effect of the Invention

The disadvantages and the like of the foregoing prior arts can be effectively eliminated, and the workability and the reliability of connector connection operation can be dramatically improved and increased. A connector can be realized which is small, has a low profile, is simple in structure, and is low in price.

DESCRIPTION OF THE REFERENCE NUMERALS

1 CONNECTOR
3 CABLE
5 PLUG
7 BASE SUBSTRATE
9, 29 SOCKET
11 PLATE-LIKE MEMBER
13 ELECTRICAL CONDUCTOR
15 FPC
17 CONTACT
19 INSULATOR
21 MATING SPACE

BEST MODE FOR CARRYING OUT THE INVENTION

Hereinafter, plural embodiments of this invention will be explained in detail with reference to drawings. However, it is needless to say that this invention itself is not limited to these.

First Embodiment

A connector of the first embodiment of this invention is explained in detail with reference to FIGS. 1 to 5.

Figure 1:
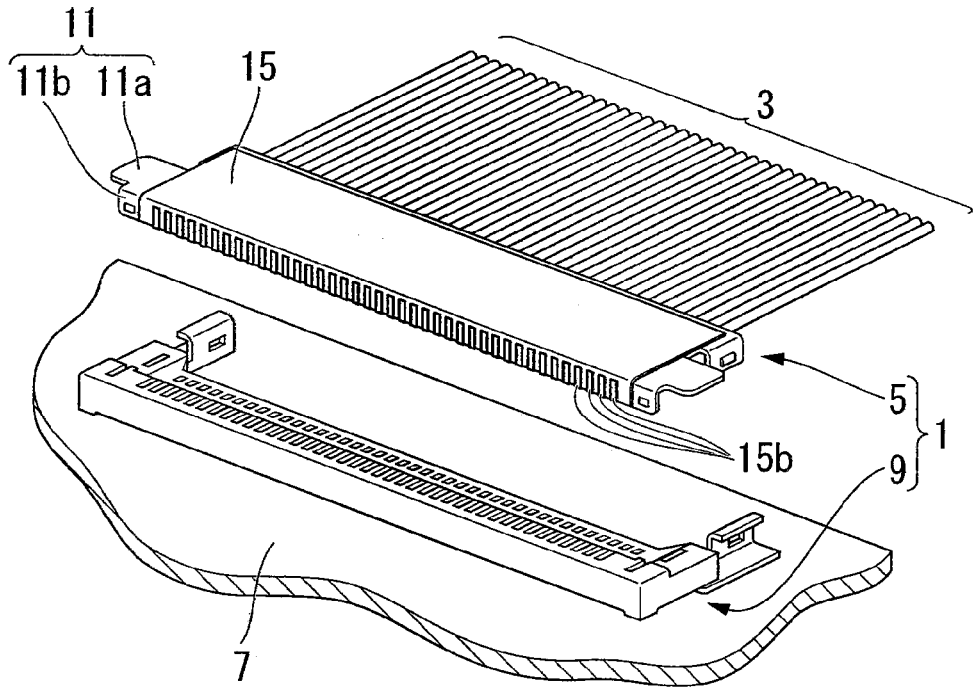
FIG. 1 is an overall perspective view of a connector of the first embodiment of this invention.

First, FIG. 1, which is an overall perspective view of a connector of the first embodiment, is referred to.

The connector 1 includes a plug 5 attached to the leading ends of a plurality of cables 3, and a socket 9 which is mounted on a base substrate 7 and in which the plug 5 is detachably mounted from the upper side in the drawing.

Figure 2:
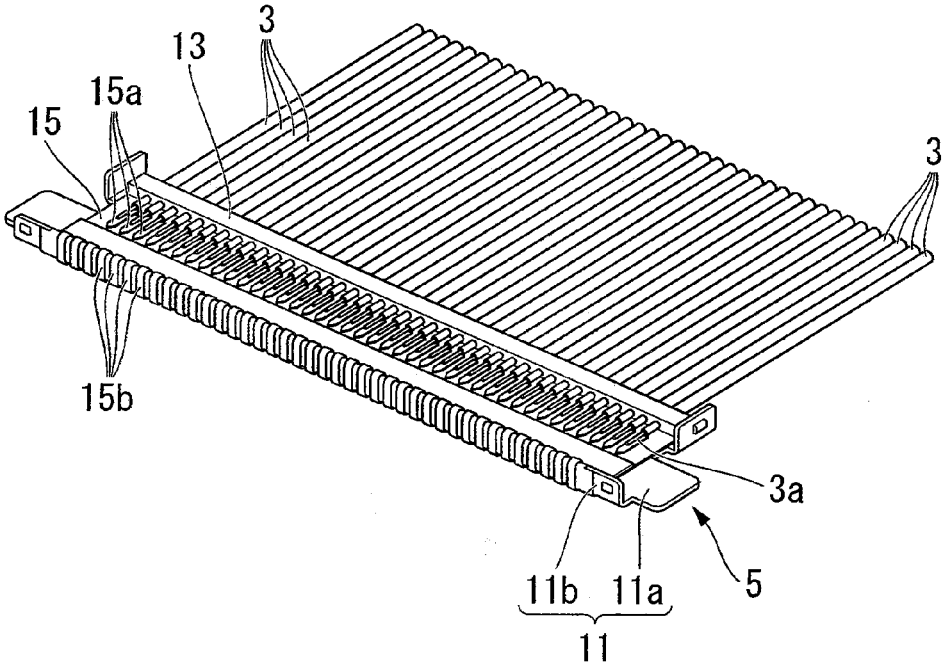
FIG. 2 is a perspective view of a plug constituting the connector of the first embodiment, as viewed from a back side.

As understood from FIG. 2 depicting the plug 5 from the side opposite to FIG. 1, each cable 3 is a so-called coaxial cable in which an electrically-conductive central core wire 3*a* is coated by an insulator, which is an outer conductor 3*b* of the surroundings thereof, and finally, by an insulating sheath (protective coating) 3*c*. The plug 5 includes a wide, metallic, plate-like member 11.

The outer conductors 3*b* of the cables 3 (coaxial cables 3) are held and fixed together to the plate-like member 11 by a single rectangular plate-like electrical conductor 13.

The plate-like member 11 has a main planar portion 11*a* and a bent portion (leading end portion) 11*b* which is bent vertically downward from one end of the planar portion 11*a*, thereby configures an approximately L shape in a transverse cross section.

Here, for convenience sake, among both of the faces of the planar portion 11*a* of the plate-like member 11, a face located on an upper side of FIG. 1 is called an upper face (or an outer face or a front face), and a face located on a lower side is called a lower face (or an inner face or a back face).

In addition, among both of the faces of the bent portion 11*b* (extending in a vertical direction) of the plate-like member 11, a face located on a front side of FIG. 1 is called an outer side face (or an outer face of the bent portion 11*b*), and a face located on a back side is called an inner side face (or an inner face of the bent portion 11*b*).

The plug 5 further includes a flexible printed circuit board 15 (hereinafter referred to as a FPC 15) which is fixed to the plate-like member 11 along the surface of the plate-like member 11.

The FPC 15 almost covers the upper and lower faces of the planar portion 11*a* of the plate-like member 11 and the outer and inner faces of the bent portion 11*b* of the plate-like member 11.

On a portion of the FPC, which is fixed to the inner face of the planar portion 11*a* of the plate-like member 11, a plurality of cable connection portions 15*a* are provided in a line at predetermined intervals (approximately the same as a distance between the cable core wires 3*a*) in a width direction of the plate-like member. Each cable connection portion 15*a* is a place which electrically connects one cable core wire 3*a* and the corresponding one circuit line (not shown) of the FPC 15.

On a portion of the FPC, which is fixed to the outer side face of the bent portion 11*b* of the plate-like member 11, contact pads 15*b* (of the same number as the total number of the cable connection portions 15*a* or the total number of the coaxial cables) are provided approximately at the same interval as the distance between the cable connection portions 15*a*. Each contact pad 15*b* is a place which electrically connects one cable core wire 3*a* and the corresponding one contact (the details thereof will be described later) of the socket 9 when the plug 5 and the socket 9 are connector-connected.

Any one cable core wire 3*a* is uniquely conductively-connected to the corresponding one cable connection portion 15*a*, and then, uniquely conductively-connected to the corresponding one contact pad 15*b* through the cable connection portion 15*a* and the corresponding one circuit line in the FPC.

Figure 3:
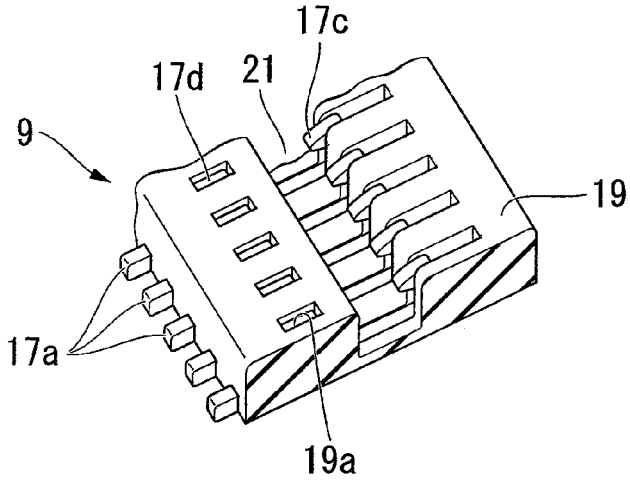
FIG. 3 is a perspective view of a principal part of a socket constituting the connector of the first embodiment.

Next, the principal parts of the socket 9 fixed to the base substrate 7 are briefly explained with reference to FIG. 3.

The socket 9 includes a plurality of contacts (electrical contacts) 17 for physically contacting with the contact pads 15*b* of the plug 5 and an insulator 19 which holds the contacts 17 in positions spaced in a line at predetermined intervals in order to enable connector connection between the plug 5 and the socket 9.

Figure 4:
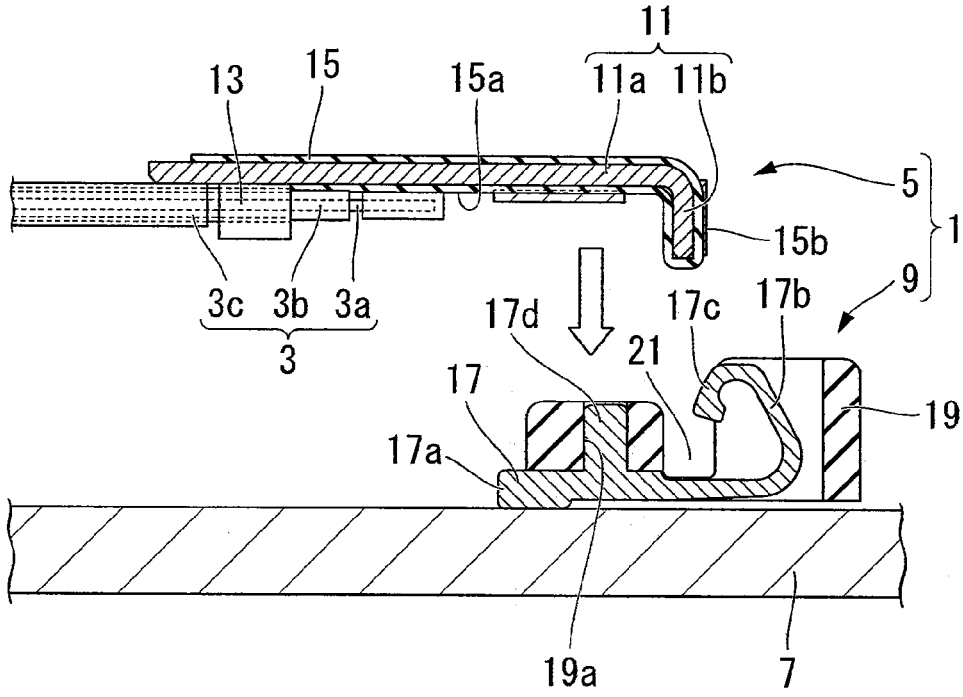
FIG. 4 is a cross-sectional side view of the plug and the socket before the plug and socket are connector-connected in the first embodiment.

The insulator 19 configures a cuboid as a whole and has a rectangular groove 21 (hereinafter also referred to as a mating space 21) which extends in a longitudinal direction at the center of the upper face so as to constitute an upper side mating space for receiving the plug 5 when the plug 5 and the socket 9 are connector-connected (FIG. 4).

Each contact 17 is formed from an electrically-conductive metal plate, one end portion 17*a* thereof protrudes from one face of the socket, and the other end portion 17*b* extends in a direction (upward direction in the drawing) perpendicular to the substrate.

The leading end 17*c* of the other end portion 17*b* partly enters the rectangular groove 21 (mating space 21) of the insulator 19 while configuring a hook shape so that it is elastically deformable (refers to FIG. 4).

An intermediate portion 17*d* of each contact 17 configures a long plate shape and is fitted in one of the fitting holes 19*a* formed in the insulator 19 at a predetermined pitch. Thus, all the contacts 17 are reliably fixed to the insulator 19.

An operation of the connector (that is, connector connection by the plug 5 and the socket 9) of the first embodiment of this invention which has a configuration as described above is briefly explained below with reference to FIGS. 4 and 5.

First, as shown in FIG. 4, the plug 5 and the socket 9 are relatively positioned such that the cables 3 and the planar portion 11*a* of the plate-like member 11 become approximately parallel to the base substrate 7 above the base substrate 7 and the bent portion 11*b* of the plate-like member 11 is located vertically above the mating space 21 (rectangular groove 21) of the socket 9.

Next, the bent portion 11*b* of the plate-like member 11 is pressed into the mating space 21 of the socket 9 by a translational and vertically downward movement of the cables 3 and the plug 5 toward the base substrate 7. At this time, the hook-like leading end 17*c* of each contact 17 of the socket 9 side is elastically deformed so as to retreat outward from the inside of the mating space 21 (refers to the arrow of FIG. 5), while maintaining physical contact with the corresponding contact pad 15*b* of the FPC 15 of the plug 5 side.

Figure 5:
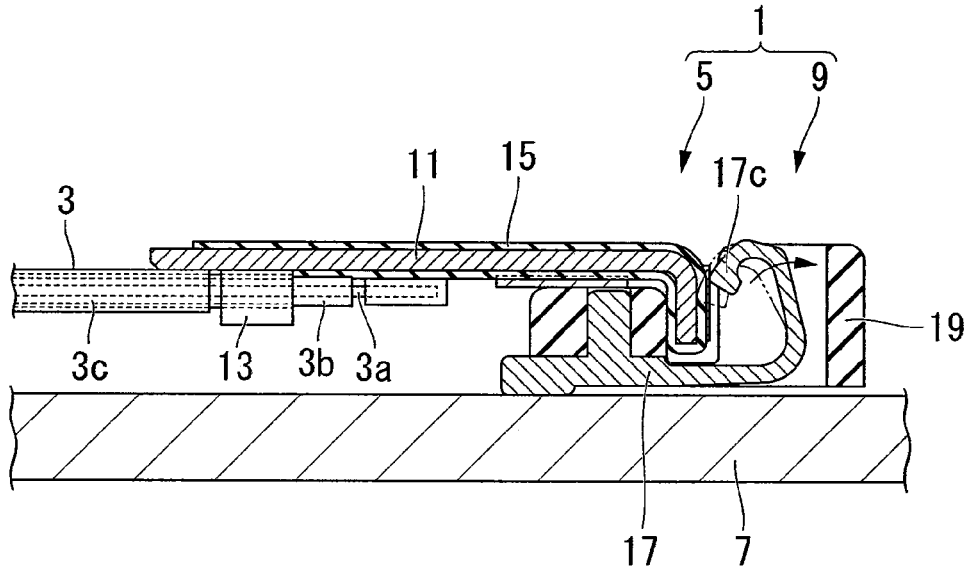
FIG. 5 is a cross-sectional side view of the plug and the socket after the plug and socket are connector-connected in the first embodiment.
Figure 6:
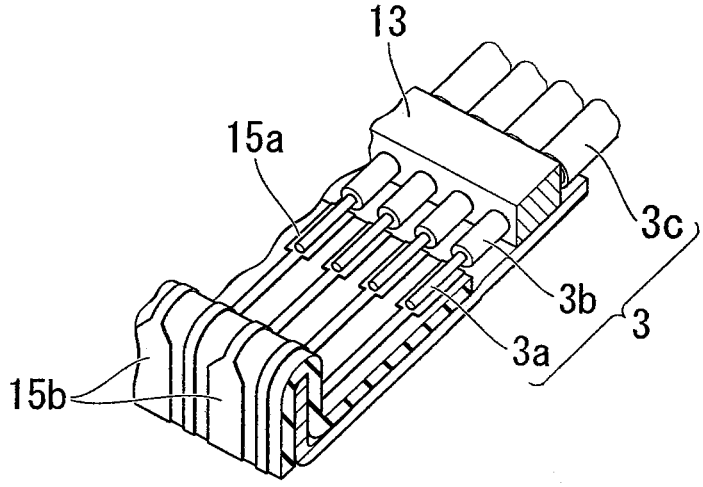
FIG. 6 is a perspective view of a principal part of a plug constituting a connector of the second embodiment of this invention.
Figure 7:
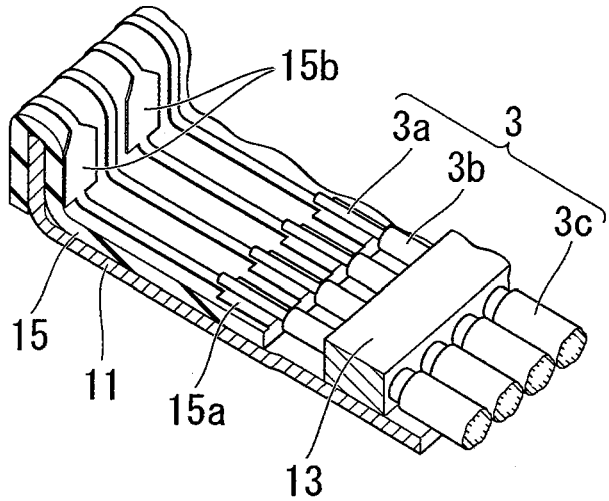
FIG. 7 is a perspective view of a principal part of the plug of the second embodiment, as viewed from a different direction from that of FIG. 6.
Figure 8:
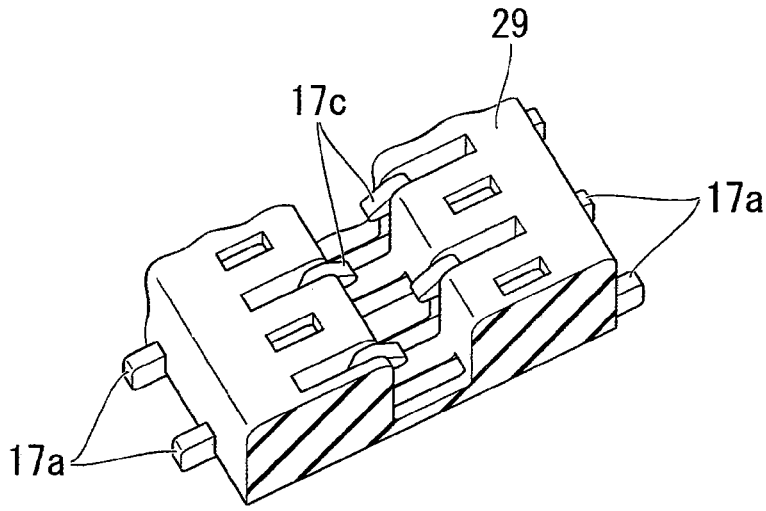
FIG. 8 is a perspective view of a principal part of a socket constituting a connector of the second embodiment.
Figure 9:
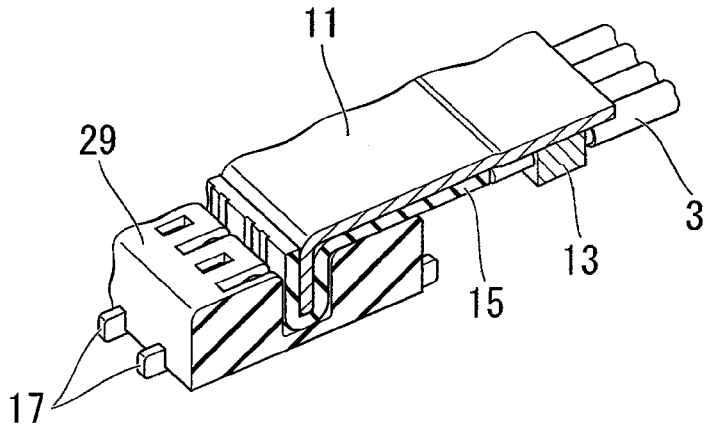
FIG. 9 is a perspective view of principal parts of the plug and the socket, which are connector-connected, in the second embodiment.
Figure 10:
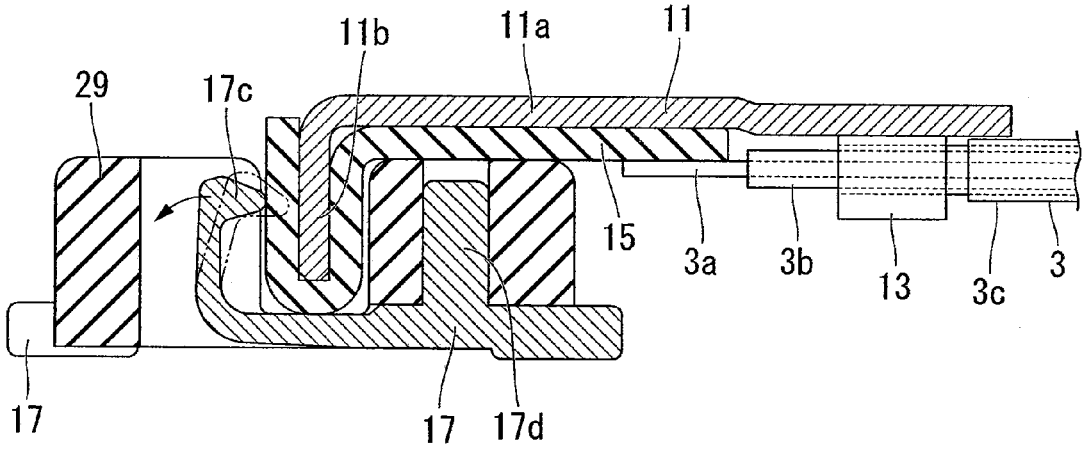
FIG. 10 is a cross-sectional side view of the plug and the socket, which are connector-connected, in the second embodiment.

Thus, as shown in FIG. 5, the electrical connection and the mechanical connection of the plug 5 and the socket 9 are complete.

Advantageous effects in the first embodiment described above are briefly explained below.

(1) The bent portion 11*b* of the plate-like member 11 extends in a direction approximately perpendicular to the substrate face of the base substrate 7 which is the other side of the connector connection. That is, the plate-like member 11 is bent in a direction perpendicular to the base substrate 7. The essential point is that it is possible to make a mating direction be a direction perpendicular to the base substrate 7 (adaption of a vertical mating method). Therefore, the workability, the certainty, and the reliability of the mating operation can be dramatically improved.

(2) Further, since it is possible to make a mating direction be a direction perpendicular to the base substrate 7, differently from a prior connector connection structure (a horizontal mating method) in which a mating direction is a direction parallel to a substrate, it is possible to secure a wide mounting space for electrical elements and/or mechanical elements on a substrate. More specifically, when the plug 5 and the socket 9 are connector-connected, it is possible to secure a wide gap between the cables 3 and the plug 5, and the base substrate 7 and the socket 9. Therefore, it is possible to arbitrarily mount the above-mentioned elements in the gap without waste in advance.

(3) Since the cable connection portions 15*a* are provided on the back face (or the mounting side to the substrate) of the plate-like member 11, when the plug 5 and the socket 9 are connector-connected, they are wholly covered by the plate-like member 11. Therefore, noise radiation to the upper side of the substrate can be reduced simply and cheaply (the arrow of FIG. 5).

(4) It is possible to relatively lengthen the distance between the cable connection portion 15*a* and the contact pad 15*b*. Although, it is possible to dispose a side on which the cable connection portions 15*a* are provided, and a side on which the contact pads 15*b* are provided, with the plate-like member 11 interposed therebetween. Therefore, at the time of the soldering operation of the FPC 15 (the cable connection portions 15*a* thereof) to the cables 3, the flow of a flux to the contact pads 15*b* and disadvantages (for example, poor contact) due to it can be reduced or avoided.

(5) In addition, since the plate-like member 11 which fixes (mechanically supports) the FPC 15 is not a mere plain plate, but has the bent portion 11*b*, the mechanical strength (in particular, bending strength) of the entire plate-like member is remarkably improved. Moreover, it is possible to make the whole of the cables 3 and the plug 5 compact (low profile). Further, since a structure is relatively simple and special skill is not needed for assembly, low-priced and simple manufacturing is possible.

Also, as a connection method of the outer conductor 3*b* of each cable 3 to the plate-like member (metal plate) 11, it is possible that the cables 3 and the electrical conductor 13 are displaced on the plate-like member 11, and then conductively connected together to the plate-like member 11 by solder. Since only one electrical conductor 13 is used at this time, low profile of the connector, cost reduction, and the like are easily realized.

At the time of the soldering operation, in addition, the conduction connection of the cable core wires 3*a* and the cable connection portions 15*a* of the FPC 15 can be performed, and it is very rational.

As plating to be carried out in advance on the plate-like member 11, it is possible to use plating with high solder affinity in a strip shape in the range to which the outer conductors 3*b* are connected, and use plating with low solder affinity in the other portion, or not to apply plating to the portion. According to this, at the time of the soldering operation, solder does not flow to an unnecessary portion, so that workability is remarkably improved.

Further, a configuration is also possible in which in place of the portion of the FPC, which is fixed to the outer side face of the bent portion 11*b* of the plate-like member 11, only on the portion of the FPC, which is fixed to the inner side face of the bent portion 11*b*, the contact pads 15*b* are provided. Furthermore, a configuration is also possible in which the contact pads 15*b* are provided on both side portions of the FPC so as to span both sides of the bent portion 11*b* of the plate-like member 11.

Second Embodiment

A connector of the second embodiment of this invention is explained with reference to FIGS. 6 to 10. First of all, the same reference numerals are applied to the same or common structure elements as those of the first embodiment, overlapping or common explanation is appropriately omitted, and distinguishing contents are briefly explained.

Also, for convenience sake, in FIGS. 6, 7, 8, and 9, only four cables 3 are depicted, and also only four contacts 17 are depicted.

Distinctive features in the connector of the second embodiment are that the contact pads 15*b* are provided alternately (in a zigzag form) at the portions of the FPC, which are located at the outer and inner faces (that is, the outer side face and the inner side face) of the bent portion 11*b* of the plate-like member 11. Also the distinctive features in the connector of the second embodiment are that the contacts 17 are constituted to be disposed in the socket 29 in such a manner that the contact portions 17*c* to be brought into physical contact with the contact pads 15*b* are located similarly in a zigzag form within the mating space to correspond to the contact pads 15*b*.

By these features, it becomes possible to make a pitch (distance) between the contact pads about ½ compared with the case of the first embodiment described above, and therefore, a connector with a narrower pitch can be realized. Since the plate-like member 11 (the contact pads 15*b* of the FPC 15) is pinched from both sides by the contacts 17, it is possible to secure and maintain equal and stable contact pressure.

Although this invention was described and shown in detail above with reference to specific embodiments, the description should not be construed as a limited meaning. Other embodiments of this invention will become apparent to those skilled in the art upon making reference to this specification. That is, various modifications of the disclosed embodiments are possible, and accordingly, such modifications can be made without departing from the scope of the invention as set forth in the appended claims.

INDUSTRIAL APPLICABILITY

A connector can be provided which has excellent workability and reliability in the connector connection operation. A small and low-profile connector can be provided. A simple connector can be provided at a lower manufacturing cost.

The invention claimed is:

1. A connector comprising a plug including a plurality of cables disposed on one side of the plug, and a socket mounted on a base substrate that is used to connect the plug; wherein the plug includes a plate-like member and a flexible substrate fixed to the surroundings of the plate-like member;

the plate-like member includes a planar portion approximately parallel to a substrate face of the base substrate, and a bent portion provided on the other side of the plug and extending in a direction approximately perpendicular to the base substrate; and the socket includes a mating space which receives the bent portion from a direction approximately perpendicular to the base substrate when the plug and socket are connector-connected, wherein the flexible substrate includes a plurality of cable connection portions which are joined to the cables, and each of the cable connection portions uniquely conductively-connects one cable to a corresponding contact pad, wherein the planar portion of the plate-like member includes a first surface facing the base substrate; and wherein the cable connection portions are provided at the portion of the flexible substrate which is fixed to the first surface of the planar portion of the plate-like member such that the cable connection portions are entirely covered by the planar portion of the plate-like member when the plug and the socket are connector-connected;

wherein a portion of the flexible substrate, which is fixed to the bent portion of the plate-like member, includes contact pads which constitute conduction elements when the plug and socket are connector-connected; and the socket includes contacts having an elastically-deformable leading end positioned in the mating space, thereby constituting corresponding conduction elements.

2. The connector according to claim 1, wherein the contact pads are provided only on one side of the portion of the flexible substrate with the bent portion of the plate-like member as a boundary.

3. The connector according to claim 1, wherein the contact pads are provided on both sides of the portions of the flexible substrate with the bent portion of the plate-like member as a boundary.

4. The connector according to claim 1, wherein the contact pads are provided on both sides of the portion of the flexible substrate so as to span both sides of the bent portion of the plate-like member.

5. The connector according to claim 1, wherein the contact pads are provided alternatively at portions of the flexible substrate, which are located at an outer side face and an inner side face of the bent portion of the plate-like member.

6. The connector according to claim 1, wherein the cable includes a central core wire, an outer conductor of the surroundings of the core wire, and a sheath covering the outer conductor, the plate-like member includes a metal plate, and the outer conductor of the cable is soldered to the plate-like member.

7. The connector according to claim 6, wherein plating with high solder affinity is applied to a portion of the plate-like member to which the outer conductor of the cable is soldered, and plating with low solder affinity is applied to the other portion.

* * * * *